US006883863B2

(12) United States Patent
Ginns

(10) Patent No.: US 6,883,863 B2
(45) Date of Patent: Apr. 26, 2005

(54) CHAIR AND TABLE ASSEMBLY

(76) Inventor: Edward William Ginns, 105 Clark Road, Londonderry, New South Wales 2753 (AU)

( * ) Notice: Subject to any disclaimer, the term of this patent is extended or adjusted under 35 U.S.C. 154(b) by 0 days.

(21) Appl. No.: 10/239,627

(22) PCT Filed: Mar. 21, 2001

(86) PCT No.: PCT/AU01/00313

§ 371 (c)(1),
(2), (4) Date: Jan. 27, 2003

(87) PCT Pub. No.: WO01/76421

PCT Pub. Date: Oct. 18, 2001

(65) Prior Publication Data

US 2003/0151276 A1 Aug. 14, 2003

(30) Foreign Application Priority Data

Mar. 21, 2000 (AU) ..... PQ 6351

(51) Int. Cl.[7] ..... A47B 85/04
(52) U.S. Cl. ..... 297/125; 297/283.3; 297/354.11
(58) Field of Search ..... 297/16.1, 16.2, 297/23, 56, 125, 124, 126, 283.3, 354.11, 92, 283.1, 1–3

(56) References Cited

U.S. PATENT DOCUMENTS 780,311 A * 1/1905 Steinbach ..... 297/35
1,310,250 A * 7/1919 Rogers ..... 297/126
1,377,773 A * 5/1921 Herzog ..... 182/33.4
1,948,387 A * 2/1934 Levy ..... 297/52
3,361,470 A * 1/1968 Erickson et al. ..... 297/124
4,194,784 A * 3/1980 Dostal et al. ..... 297/126
5,609,390 A * 3/1997 Takafuji ..... 297/55
5,882,069 A 3/1999 Gunnett et al.
6,189,965 B1 * 2/2001 Hecht et al. ..... 297/124

FOREIGN PATENT DOCUMENTS

| | | |
|---|---|---|
| AU | 27511/88 | 6/1989 |
| FR | 2 748 377 | 11/1997 |
| GB | 2 166 947 | 5/1986 |

* cited by examiner

*Primary Examiner*—Peter M. Cuomo
*Assistant Examiner*—Stephen Vu
(74) *Attorney, Agent, or Firm*—Shalom Wertsberger; Saltamar Innovations

(57) ABSTRACT

A folding combination chair and table assembly including a seat mounted on support legs and a back rest mounted on a support which is continuous with one of the legs; the back rest capable of rotation about said support such that in one position it forms a back rest and in another a bench or a table; wherein said back rest is supported by the support at a side edge of the back rest and wherein the support is disposed at a location which allows a person seated on the chair to adopt a first seated position in which the person back engages the back rest and a second seated position in which wherein the person may use the backrest as a table and rotate his or her legs from said first position to the second position without obstruction by said rest support member.

8 Claims, 3 Drawing Sheets

CHAIR AND TABLE ASSEMBLY

BACKGROUND

The present invention relates to seats and more particularly relates to combined seat and table assemblies capable of movement between a chair configuration and a chair table configuration for performing different functions. More particularly the invention relates to a chair table assembly in which the chair back converts to a table allowing a user to assume a repose from a position in which the user leans on a back rest and rotate to a position in which the user may employ the back rest as a table without leg obstruction.

PRIORT ART

There are already in existence a variety of bench seats which can convert from one working configuration into another working configuration. In order to achieve an edge over competitors, seat manufacturers have made attempts produce seats and seat assemblies which convert into an alternative configuration to satisfy an ancillary or alternative purpose.

An example of a known seat assembly is disclosed in U.S. Pat. No. 5,882,069 which allows a user to arrange the seat unit described into a number of positions for different uses. When use of the seat is desired the back section is oriented so that it is approximately perpendicular to the approximately horizontal orientation of the seat section. When the use wishes to re orientate the direction in which the use is sitting the support arm is pivoted around the base and the back section in rotated around the support arm. This rearrangement reverses the orientation of the chair unit formed by the seat section and back section. Alternatively the back section may be rotated so that its rear surface is in an upwardly facing horizontal orientation. Also the seat back section may simultaneously be placed in vertical orientations. Although, this chair has a number of advantages due to its versatility, it has a disadvantage that the user cannot take advantage of the natural chair table configuration where the user has the table in front without the user having to leave the seat before changing to the desired chair table configuration. In the invention described in that patent, the user may change an adjacent back rest to form a side table and although it may be possible to form a support with the back rest of the seat the user is seated on the table shown would be positioned awkwardly so as to cause discomfort to the user.

UK Patent 2166947 discloses a foldable seat arrangement having transverse seat members and transverse back rest table top members carried on transversely spaced folding frames. In one position, the backrest transverse members are supported as an upright backrest for seated persons. In another position the backrest transverse members are supported by props from rearwardly inclined backrest supports in a horizontal table top posture. As with the known seating assemblies of this type the use must leave the seat temporarily to reseat at 180-degrees to face the reconfigured back portion forming a table. The user cannot swivel in the same seated position to face the table due to the obstruction caused by the backrest.

French specification 2748377 discloses an alternative chair assembly which includes a back rest which converts into a table top. In use, a person seated on the chair must in order to face the backrest when converted to a table top leave the seat and reposition to face the table. This is necessitated due to the obstructions caused by the back rest supports which prevent a user from rotating 180 to adopt the correct repose for sitting at the table. In the seating assembly described, the users legs must straddle the back rest supports which is not an ideal seating arrangement. Also adopting and withdrawing from the seating position is awkward as one or other of the users legs must negotiate the back rest support struts.

Australian patent specification 27511/88 discloses a chair table combination comprising a seat raised above the ground on legs with a support connected to the seat to which is connected a panel pivotally connected to the support and adjustable between a fist mode in which the panel serves as a back rest for the seat and a second mode in which the panel serves as working surface.

As with the earlier examples described, the back rest support provides an obstruction for the user of the chair table combination. A person seated on the chair must in order to face the back rest when converted to a table top leave the seat and reposition to face the table. This is necessitated due to the obstruction caused by the centrally disposed back rest support which prevents a user from rotating 180 to adopt the correct repose for sitting at the table. In the seating assembly described, the users legs must straddle the central back rest support which is not an ideal seating arrangement. Also adopting and withdrawing from the seating position is awkward as one or other of the users legs must negotiate the back rest support.

INVENTION

The present invention provides an alternative to the known chair table combinations with more simple construction and allowing a user seated on the chair to face a table surface without obstructions to the leg and without leaving the chair.

In one broad form the present invention comprises:

a folding combination chair and table assembly including a seat mounted on support legs and a back rest mounted on a support which is continuous with one said legs; the back rest capable of rotation about said support such that in one position it forms a back rest and in another a bench or table; wherein said back rest is supported by said support and wherein said support is disposed at a location which allows a person seated on the chair to adopt a first seated position in which the persons back engages said back rest and a second seated position wherein the person may adjust then use the back rest as a table and rotate his or her legs from said first seated position to said second seated position without obstruction by said back rest support member.

According to a preferred embodiment of the chair table assembly, the support member is integral with said one said legs and which terminates in a free end. Preferably the back rest is rotatable about a longitudinal axis of said free end of said support. The support is located generally in a plane normal to a plane of said seat and the back rest is releasably attached to said free end of said support which is disposed normal to the remainder of said support.

According to one embodiment, the legs of the chair are capable of pivoting relative to each other.

The chair preferably has two legs the first of which comprises a square member and the second comprising a square member which is dimensioned to fit within the boundaries of said first leg; wherein, said first leg includes integral with one side an extension forming said support.

The support ideally has an angle of repose which is the same as the angle of repose of said first leg but the back rest may be disposed at an angle parallel to said support or at an angle relative to the angle of the support. A face of said back rest provides an upper surface of said table.

The back rest includes an opening which receives and retains the free end of the support with the free end including a formation which enables said back rest to be releasably retained by said support.

The formation allows rotation of said back rest through at least 60 degrees and up to 360 degrees depending upon the mechanical arrangement between the back rest and free end of the support. The back support is disposed so as to allow a user to rotate 180 degrees from the first seated position to the second position facing the table surface and without obstruction from the support.

In another broad form the present invention comprises;

a folding combination chair and table assembly including a seat mounted on support legs and a back rest mounted on a support which is continuous with one said legs; the back rest capable of rotation about said support such that in one position it forms a back rest and in another a bench or table; wherein said back rest is supported by said support and wherein said support is disposed at a location which allows a person seated on the chair to adopt a first seated position in which the persons back engages said back rest and a second seated position wherein the person may adjust then use the back rest as a table and rotate his or her legs from said first seated position to said second seated position without obstruction by said back rest support member; wherein the assembly further includes a mechanism which provides a restriction of rotation of said back rest relative to said support.

DETAILED DESCRIPTION

The present invention will now be described in more detail according to a preferred but non limiting embodiment and with reference to the accompanying illustrations; wherein FIG. 1 shows a perspective view of a combination chair table assembly according to a preferred embodiment of the invention.

Figure 1:
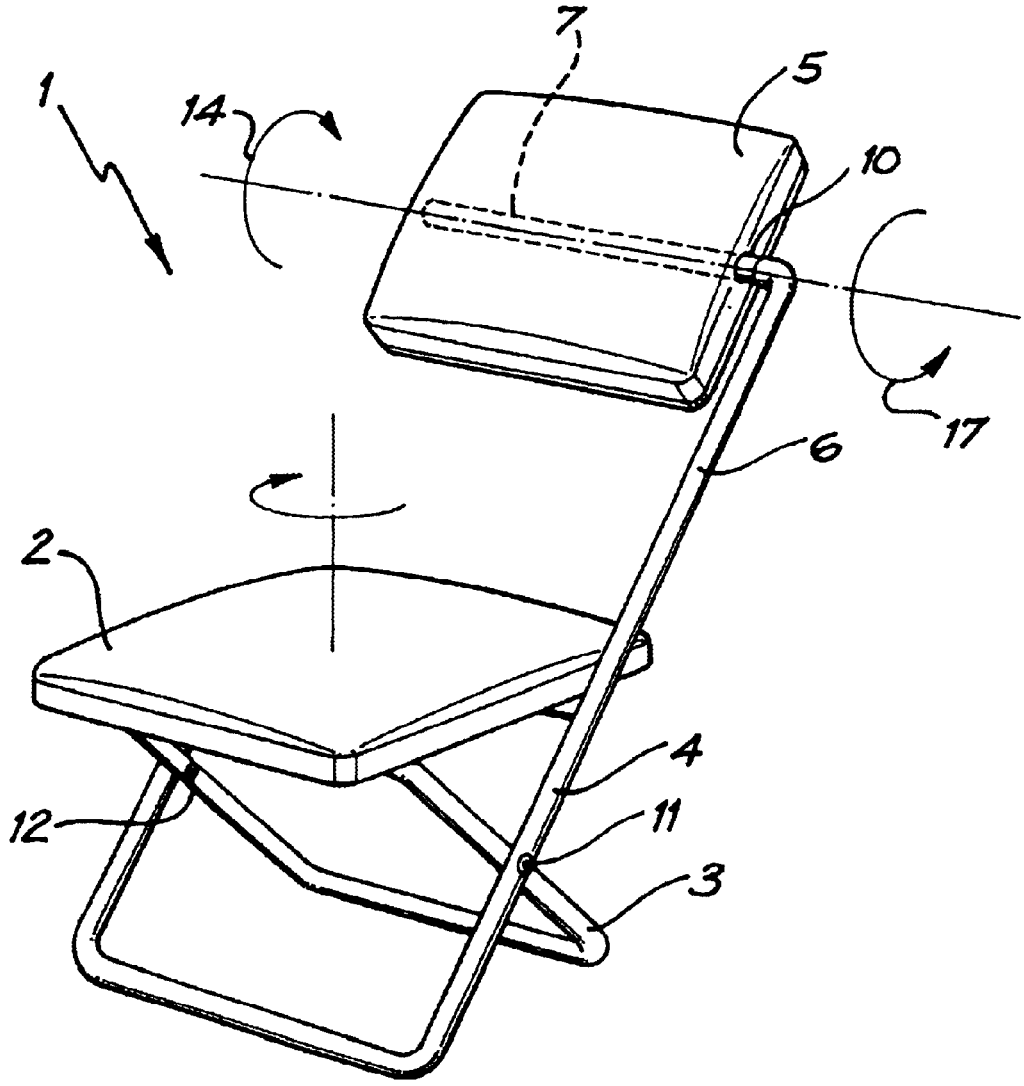

Referring to FIG. 1 there is shown a folding chair and table assembly 1 including a seat 2 mounted on support legs 3 and 4. The assembly further comprises a back rest 5 mounted on a support 6 which is integral and continuous with one said leg 4. Support 6 terminates in free end 7 of support 6 which receives and retains back rest 5. Back rest 5 is capable of rotation about said free end 7 of support 6 such that in one position surface 8 forms a back rest surface and in another position a bench or table surface. Back rest 5 is supported by support 6 at a side edge 9 of the back rest. Side edge 9 includes an opening 10 which allows passage therethrough of free end 7. Free end 7 includes a formation which enables back rest 5 to rotate about an axis along free end 7 through at least 180 degrees. This enables a user of the assembly to set back rest 5 as a back rest or a table surface. As shown in FIG. 1, support 6 is located laterally of seat 2 and at a location which allows a person seated on the chair to adopt a first seated position in which the persons back engages back rest surface 8 and a second seated position wherein the person may use the back rest surface 8 as a table when the back rest 5 is rotated through about 30–45 degrees in the direction of arrow 14. The user may adopt a position facing the table surface from the seating position without having to leave the seat and by rotating his or her legs from the first seated position to the second seated position without obstruction by back rest support member 6. Previously this has not been possible with the prior art arrangements as the latter all require the user to leave the seated position and negotiate supports with the users legs to adopt a position facing a table surface provided by rotating the back rest. According to a preferred embodiment of the chair table assembly 1, the support member is integral with leg 4. Leg 4 is preferably a generally square member which is proportioned to receive in pivotal engagement leg 3 which itself is a generally square member proportioned to fit inside the opening defined by leg 4. Leg 3 is pivotally attached to leg 4 via pivots 11 and 12 and this enables the legs to move relative to each other to enable folding of the chair table assembly 1. Support 6 is located generally in a plane normal to a plane of seat 2 and the back rest is releasably attached to said free end 7 of support 6. Free end 7 is preferably disposed normal to a longitudinal axis of support 6 as a return cantilevered from support 6. In an alternative embodiment, a back surface 13 of back rest 5 may be presented as a table surface rather than surface 8. The user may choose which of surfaces 8 or 13 is used for the back surface provided the engaging formation on free end 7 is adapted to allow 360 degree rotation.

Support 6 ideally has an angle of repose which is the same as the angle of repose of leg 4. but the back rest 5 may be disposed parallel to leg 4 or at an angle relative to the angle of the support. A face of the back rest provides an upper surface of the table. The back support is disposed so as to allow a user to rotate 180 degrees from the first seated position to the second position facing the table surface about the axis indicted by arrow 24 ( see FIG. 1) and without obstruction the user by the support when assuming the table position and when at the table.

Figure 2:
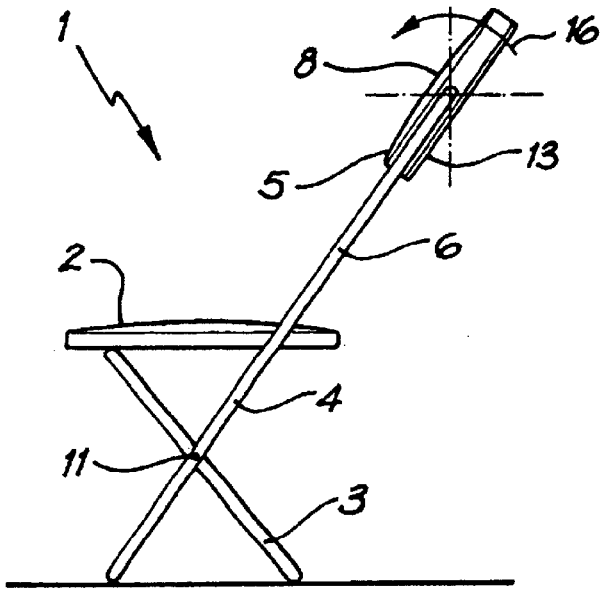
FIG. 2 shows a side profile of the chair table combination of FIG. 1.
Figure 4:
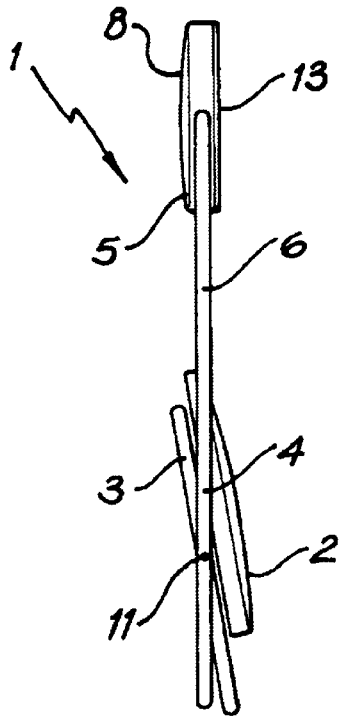
FIG. 4 shows the chair table combination of FIG. 3 in the folded configuration.
Figure 3:
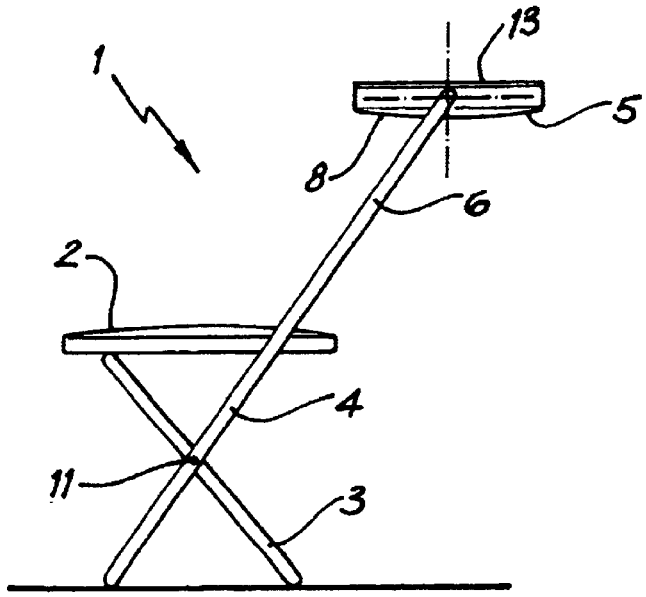
FIG. 3 shows the profile of FIG. 2 with back rest converted to a table.

FIG. 2 shows a side profile of the chair table combination of FIG. 1. In that configuration, back rest 5 is disposed in general alignment with support 6 to enable back support of a use in a conventional manner. FIG. 3 shows the profile of FIG. 2 with back rest 5 converted such that surface 8 which previously acted as a back rest is now a table top. FIG. 4 shows the chair table combination of FIG. 3 in the folded configuration and with back rest 5 returned to the seating configuration.

Figure 5:
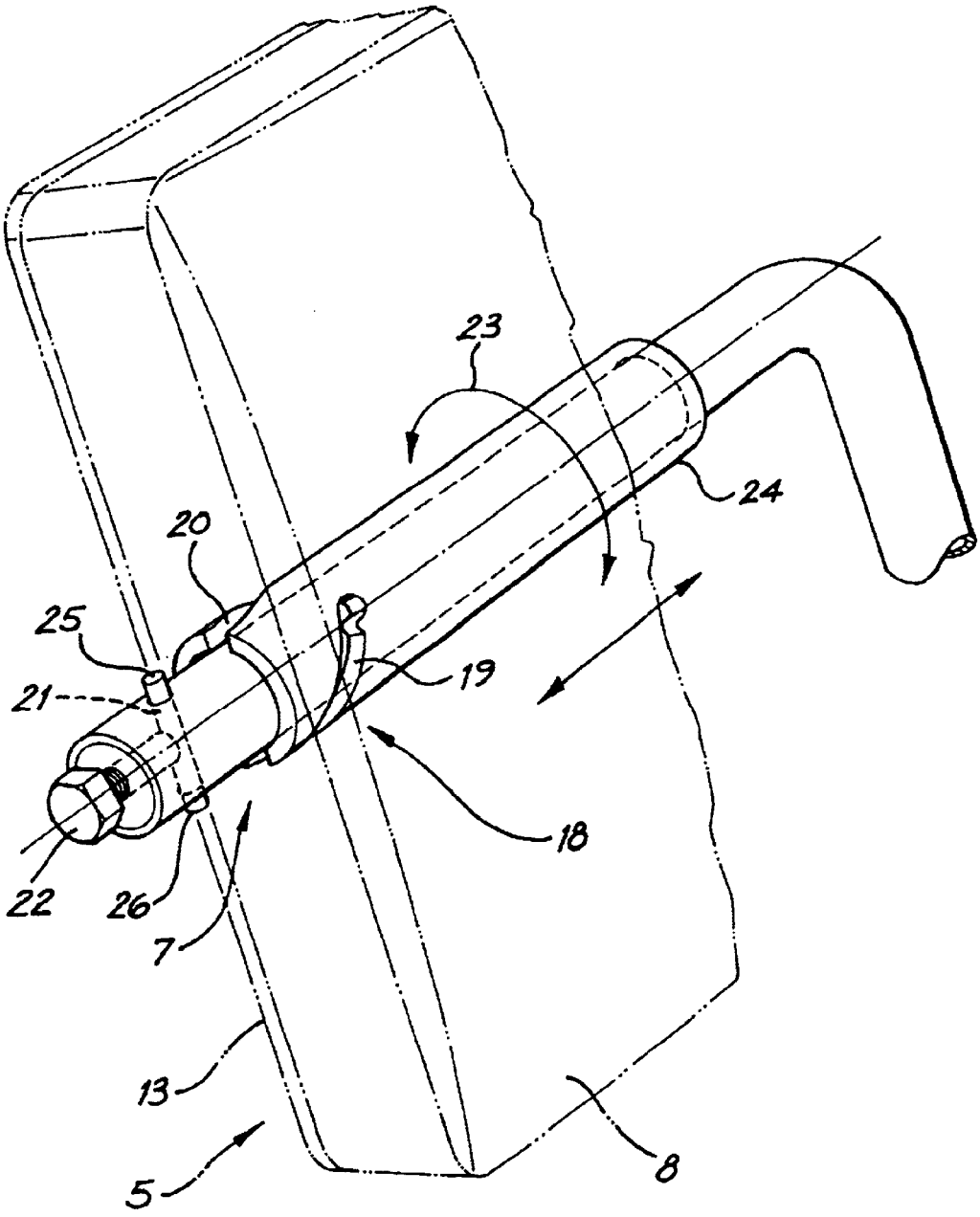
FIG. 5 shows a perspective view of a formation on a free end of the back rest support which enables adjustment of the back rest from back rest to table top.

FIG. 5 shows a perspective view of a locking mechanism according to one embodiment of the invention. The arrangement includes formation 18 on an exploded free end 7 of the back rest support which enables adjustment of the back rest from a back rest to table top. Depending upon how the formation is arranged the user may be restricted according to one embodiment to a back rest rotation in a first direction of rotation of no more than 60 degrees from a back support angle to a horizontal disposition forming a table. Alternatively, the formation may allow for rotation in an opposite direction of up to 130 degrees. Furthermore, the formation allows for the back rest to be totally removed, rotated and then replaced to allow the user to choose surface 8 or 13 as the table top. The arrangement of FIG. 3 shows the back rest 5 rotated through approximately 130 degrees as indicated by arrow 16 of FIG. 2 and arrow 17 of FIG. 1 so that surface 13 acts as a table top. Alternatively, back rest 5 may be rotated 360 degrees on said free end of said support.

The arrangement of FIG. 5 allows up to 360 degrees rotation of the back rest 5 when free of locking dowel 21. Back rest 5 includes a retaining member which may be formed from a tube 24. Tube 24 is fixedly attached to back rest 5 and includes formation 18 comprising cut out portions 19 and 20 which receive respective ends 25 and 26 of locking dowel 21 which is mounted on bolt 22. Back rest S is fed along free end 7 until locking dowel 21 engages cut outs 19 and 20 whereupon the back rest may be rotated until it is in either the back rest or table configuration. Back rest 5 may be rotated in either direction as shown by arrow 23 but movement will be restricted by locking dowel 21. According to one embodiment each recess may include a protrusion which provides positive locking of locking dowel 21. For example recess 19 includes protrusion 27 which engages end 26 of locking dowel 15 when it engages recess 19. This allows back rest 5 to locate in position. The configuration of the recess 19 and 20 may be arranged to accommodate the required degree of rotation of the back rest and its utility as either a table or back rest.

It will be recognized by persons skilled in the art that numerous variations and modifications may be made to the invention as broadly described herein without departing from the overall spirit and scope of the invention.

The claims defining the invention are as follows:

1. A folding combination chair and table assembly comprising a seat mounted on a plurality support legs and a back rest mounted on a support which is continuous with one of said legs; the back rest capable of rotation about said support such that in one position it forms a back rest and in a second position, a bench or table; wherein said back rest is supported by said support at a side edge of the back rest and wherein said support is disposed at a location which allows a person seated on the chair to adopt a first seated position in which the persons back engages said back rest and a second seated position wherein the person may use the back rest as a table and rotate his or her legs from said first seated position to said second seated position without obstiuction by said back rest support member; wherein said support member is integral with one of said legs and which terminates in a free end and located generally in a plane parallel to a plane of said seat; wherein the back rest is releasably attached to said free end of said support and rotatable about a longitudinal axis of and attached to said free end; wherein said back rest may be disposed at an angle parallel to said support or at an angle relative to the angle of said support; said strut having an angle of repose which is substantially the same as the angle of repose of said first leg and wherein a face of said back rest provides an upper surface of said table.

2. The chair table assembly according to claim 1 wherein said beck rest futher comprising an opening which recieves and retains said free end of said support.

3. The chair table assembly according to claim 2 wherein free end of said support further comprises a formation which enables said back rest to be releasably retained by said support.

4. The chair table assembly according to claim 3 wherein said back rest may rotate relative to said support up to 360 degrees.

5. The chair table assembly according to claim 4 wherein said formation on said free end comprises a locking dowel whose ends engage a corresponding recess formed in a member attached to said back rest.

6. The chair table assembly according to claim 5 wherein said cut out portions are arranged to allow a predetermined degree of rotation of said back rest about said free end when said cut out portions engage with said locking dowel.

7. The chair table assembly according to claim 6 wherein said locking dowel governs degree of rotation of said back rest by engagement with an edge of said cut out portions; wherein the cut out portions are disposed circumferentially about said member attached to said back rest.

8. The chair table assembly according to claim 7 wherein said back support is disposed relative to said seat so as to allow a user to rotate 180 degrees from said first seated position to said second position facing said table surface and without obstruction from said support.

* * * * *